US007481047B2

(12) United States Patent
Radel et al.

(10) Patent No.: US 7,481,047 B2
(45) Date of Patent: Jan. 27, 2009

(54) REFLECTION CATALYTIC CONVERTER

(75) Inventors: Harry Radel, Geesthacht (DE); Markus Kruger, Bad Segeberg (DE)

(73) Assignee: Dolmar GmbH, Hamburg (DE)

( * ) Notice: Subject to any disclaimer, the term of this patent is extended or adjusted under 35 U.S.C. 154(b) by 151 days.

(21) Appl. No.: 11/155,198

(22) Filed: Jun. 16, 2005

(65) Prior Publication Data

US 2005/0284140 A1 Dec. 29, 2005

(30) Foreign Application Priority Data

Jun. 17, 2004 (DE) ..... 20 2004 009 506 U
Dec. 20, 2004 (DE) ..... 20 2004 019 896 U

(51) Int. Cl.
*F01N 3/00* (2006.01)

(52) U.S. Cl. ..... 60/296; 60/299

(58) Field of Classification Search ..... 60/296, 60/299; 422/176, 180

See application file for complete search history.

(56) References Cited

U.S. PATENT DOCUMENTS 4,206,177 A * 6/1980 Otsubo et al. ..... 422/171
5,512,250 A 4/1996 Betta et al.
2003/0190269 A1 * 10/2003 Liu et al. ..... 422/168

FOREIGN PATENT DOCUMENTS

DE 197 04 147 A1 8/1998
DE 198 45 381 C1 12/1999
DE 19932778 * 1/2001

* cited by examiner

*Primary Examiner*—Thomas E Denion
*Assistant Examiner*—Diem Tran
(74) *Attorney, Agent, or Firm*—Kelly Lowry & Kelley LLP

(57) ABSTRACT

To provide an exhaust system (100) for a combustion engine having a housing (10) in which at least one aperture for an exhaust gas inlet (11) and an additional aperture for an exhaust gas outlet (12) are provided, and having a catalytic element that is arranged in the housing (10) of the exhaust system (100) for cleaning exhaust gases from the combustion engine, and which can be manufactured simply and inexpensively, yet still achieves a high conversion rate to satisfy increasingly stringent environmental regulations, it is suggested to arrange at least one cleaning unit (13) including at least the described catalytic element (14) and a reflection means (15) in housing (10) of the exhaust system (100), in which some or all of the exhaust gases are directed through the catalytic element (14) of the cleaning unit (13) before reaching the reflection means (15) disposed behind it, which directs the exhaust gases (22) through the catalytic element (14) again, this time from the other side.

21 Claims, 5 Drawing Sheets

REFLECTION CATALYTIC CONVERTER

RELATED APPLICATIONS

This Application claims priority to German Utility Model No. 20 2004 009 506.8 filed on Jun. 17, 2004, and German Utility Model No. 20 2004 019 896.7 filed on Dec. 20, 2004.

BACKGROUND OF THE INVENTION

The invention relates to an exhaust system for a combustion engine, in which the engine may be either a four-stroke or a two-stroke petrol engine. The use of an exhaust system in two-stroke engines is especially advantageous, however. Because of its compact construction, this exhaust system may also be used in hand-operated tools, such as petrol-driven chainsaws, hedge trimmers or similar. The exhaust systems includes a housing in which at least one aperture is provided for an exhaust gas inlet, and a further aperture is provided for an exhaust gas outlet. To prevent the exhaust gases from escaping into the atmosphere without being cleaned, at least one catalytic element is also arranged in the housing, so that some or all of the exhaust gases flow through the catalytic element before they escape into the atmosphere through the gas outlet aperture.

It is known from the prior art to used catalytic elements in exhaust systems to reduce emissions of pollutants from combustion engines. These catalytic elements enable subsequent treatment of the exhaust gas with the components contained in the gas. The hydrocarbons are converted to carbon dioxide or carbon monoxide using the residual oxygen content. For lower conversion rates, i.e. if not all hydrocarbons are converted into carbon dioxide or carbon monoxide, coated metal meshes may be useful instead of the usual honeycomb catalytic converters. In a broader comparison with honeycomb catalytic converters, the production of 2-dimensional catalytic element is particularly simple and correspondingly cheaper.

In this context, the object of the invention was to provide an exhaust system having a catalytic element that may be manufactured easily and inexpensively but with which a high conversion rate may be achieved, to satisfy increasingly stringent environmental regulations.

This object is solve by the features listed in claim 1, which are particularly significant for the following reasons.

SUMMARY OF THE INVENTION

The exhaust system according to the invention for a petrol combustion engine includes a housing, in which at least one aperture for an exhaust gas inlet and a further aperture for an exhaust gas outlet are provided. A cleaning unit is provided inside the housing of the exhaust system and includes at least one catalytic element and one reflection means. The cleaning unit may be simply attached to the inside of the housing by a welded joint, a positive and/or non-positive locking fixture. The arrangement of the catalytic element with regard to the reflection means is equivalent to the principle of a container, the opening of which is partly or completely covered by a sieve. The cleaning unit itself is arranged in the housing in such manner that at least the inflowing exhaust gases are directed partly or entirely through the catalytic element in the cleaning unit. In order to ensure that these partially converted exhaust gases are passed through the same catalytic element again, the reflection means is arranged behind the catalytic element. When they have passed through the catalytic element, the exhaust gases are forces against the reflection means, by which they are reflected back towards the catalytic element from which they have just emerged, and must pass through it again, this time from the other side. Then, at least a portion of the repeatedly converted exhaust gases is able to escape into the atmosphere or the environment through the aperture for exhaust gas outlet. Another fraction of the converted exhaust gases is mixed with the inflowing exhaust gas and is directed through the catalytic element in the cleaning unit again. This mixing of cold, inflowing exhaust gas with the hot, partially converted exhaust gas, the thermal load on the catalytic element is lowered. This in turn increases the operating life of the catalytic element. Since the partially converted exhaust gas is also forced to pass through the catalytic element the cleaning unit multiple times, conversion is also improved. In addition, the residence time of the exhaust gases in the exhaust system is increased artificially. In this way, optimum cleaning effect may be achieved with just cone catalytic element. The frequent passes through the catalytic element mean that the exhaust system may be quite small, thereby also reducing expenses for materials. As a result, the exhaust system according to the invention may be installed or retrofitted without difficulty in existing exhaust designs. In summary—with the measure described previously—the conversion rate of the exhaust system may be significantly improved with a simple construction and small dimensions. Furthermore, use of the cleaning provides an enhance noise damping effect, which is based on deliberate reflection of the exhaust gases.

Further advantageous configurations of the exhaust system are described in subordinate claims 2 to 18.

To improve the conversion rate of the exhaust system according to the invention yet further, the exhaust gases may be directed multiple times from both sides through the same catalytic element. To this end, the cleaning unit must be arranged in such manner in the housing that a large portion of the reflected exhaust gases is directed back to the cleaning unit by the housing or the housing wall, In this way, the exhaust gases are able to be almost completely converted with just one, particularly flat catalytic element, before they escape into the atmosphere through the outlet aperture.

In a further embodiment of the exhaust system, the reflection means is configured in a bowl or parabolic shape. The catalytic element is then arranged at least partly in front of an aperture in the reflection means. The bowl-shaped or parabolic design of the reflection means causes the exhaust gases to be reflected in controlled manner, so that a flow path through the exhaust system may be controlled. By this means, a portion of the exhaust gases may be reflected in a predictable and defined manner, so that it flows through the catalytic element from both sides several times.

A further embodiment of the exhaust system provides that the entire aperture of the reflection means is covered by the catalytic element, so that all reflected exhaust gases are directed through the catalytic element at least twice. The catalytic may be flat, arcuate, corrugated or some other similar shape. Increasing the surface area of the catalytic element also serves to improve the chemical conversion process taking place in the exhaust gases.

To prevent all reflected exhaust gases from flowing through the same point in the catalytic element, which would result in achieving only a moderate conversion rate, a further variant of the exhaust system is suggested in which a floor of the reflection means has a corrugated or relief profile. The individual rises or irregularities in the floor may prevent the accumulation of reflected exhaust gases, so that the exhaust gases are able to flow in even distribution over the entire surface of the catalytic element.

A simple an inexpensive variant of the exhaust system according to the invention provides that the reflection means constitutes a part of the housing. In this case, the entire reflection means does not need to be formed by the housing, but for example the floor of the reflection means may be replaced by a housing wall. This measure serves to cut material requirements and weight. Also, the already partly converted and therefore hot exhaust gases may be cooled better in the cleaning unit, so that the operating life of the catalytic element is extended. To this end, the corresponding housing wall might also be conformed with corrugations or in relief, to dissipate heat over a larger surface area.

In a particularly resilient design of the exhaust system according to the invention, the reflection means is constructed partly or entirely from stainless steel. The use of stainless steel serves to prevent corrosion of the reflection means, which is particularly exposed to the chemically aggressive exhaust gases. In this way, the overall operating life of the exhaust system may be prolonged. If the reflection means does not form an integral part (like the variant described previously) with the housing, the entire housing may be fabricated from a simple steel panel. Of course the housing and other components of the exhaust system may also be galvanized to extend their operating life.

In a special embodiment, the cleaning unit is disposed opposite the aperture for the exhaust gas inlet. In this way, it is possible to ensure that as far as possible all inflowing exhaust gases pass into the cleaning unit and consequently are directed through the catalytic element of the cleaning unit at least twice. This also ensures that a large portion of the reflected exhaust gases is mixed with the inflowing, cold exhaust gases. Under the effects of the prevailing flow and pressure conditions, the mixed exhaust gases are passed back to the cleaning unit that is facing the aperture for the exhaust gas inlet. Consequently, this exhaust system demonstrates a high conversion rate.

To improve this conversion rate yet further, a cleaning unit may contain multiple catalytic elements. For example, with two or three catalytic elements arranged side by side, the efficiency of the cleaning unit is enhanced considerably. In the same way, it is conceivable that a cleaning unit may also contain multiple reflection means, which are covered by one or more catalytic elements. In an arrangement with multiple reflection means, the inflowing exhaust gases may be reflected more precisely and more variably, i.e. in many different directions.

In a further embodiment of the exhaust system, at least two cleaning units are arranged inside the housing. In this way, the exhaust gases may be reflected from one cleaning unit to the other and vice versa. A particularly simple arrangement of the two cleaning units is achieved if the second cleaning unit is disposed opposite the first cleaning unit. In this way, a constantly repeating cycle or a "ping-pong" effect may be achieved, in which the exhaust gases pass through the same cleaning units multiple times before they finally escape from the exhaust system.

A particularly interesting embodiment of the exhaust system is achieved if at least one additional catalytic element is arranged in the housing besides the existing cleaning unit, and through which at least some of the exhaust gases are directed. This is preferably to be arranged in the housing in such manner that all inflowing and outflowing exhaust gases must flow through this additional catalytic element. To this end, the additional catalytic element may enclose the aperture of the exhaust gas inlet in the interior of the housing, so that the inflowing exhaust gases must pass through the additional catalytic element first. Therefore, reference will also be made in the following text to an additional, first catalytic element. The location of the additional, first catalytic element behind the inlet aperture has the advantage that the exhaust gas counterpressure necessary for the operation of a two-stroke engine is created. If the first catalytic element has an curved shape, at the same time the exhaust gas flow may be directed optimally to the existing cleaning unit, since the speed and inertia of the exhaust gas flow created at this point renders this particularly simple. It is also conceivable to arrange the additional catalytic element in front of the exhaust gas outlet aperture, though this arrangement has the disadvantage that the outflowing exhaust gases are heated again before the escape to the outside.

To construct an exhaust system as inexpensively as possible, mesh-type or perforated panel catalytic elements such as are commercially available as inexpensive semi-finished parts may be used, since the exhaust gases are forced through at least the catalytic element of the cleaning unit multiple times anyway. The use of 2-dimensional catalytic elements is a practical solution for the catalytic element in the cleaning unit and for the additional catalytic elements. Because of the special design of the exhaust system according to the invention, this enables high conversion rates to be achieve, such as would only be achievable otherwise with expensive honeycomb catalysts. Accordingly, conversion rates of more than 50% were measured in an exhaust system of the described construction (such as was described in the previous section, see also FIGS. 1 and 2) with mesh-type or perforated panel catalytic elements. Moreover, the 2-dimensional, mesh-type or perforated panel catalytic elements have the advantage that they do not heat up as much as the comparable honeycomb catalytic converters and they have a lower flow resistance. As a result, the 2-dimensional catalytic elements have a longer operating life. In addition, the performance of the combustion engine is scarcely affected.

In an further embodiment of the exhaust system, the catalytic element may be constructed to be self-supporting. In this way, additional support or retaining constructions for positioning the catalytic elements inside the housing or for affixing them on or above the reflection means may be dispensed with. In addition, the possible uses of the catalytic elements are expanded thereby, since they allow almost unlimited shape variations.

In a further embodiment, the catalytic elements may be welded or soldered or otherwise permanently joined to each other at the contact points of the mesh-forming elements, to improve mechanical strength.

Also, partially coated catalytic elements may be used in a particularly inexpensive embodiment of the exhaust system. For example, it is not necessary to coat the points where the catalytic elements contact the housing or the reflection means, because no exhaust gases are able to pass over these points anyway.

BRIEF DESCRIPTION OF THE DRAWINGS

In the following, the invention is explained in greater detail with reference to the attached drawings and in various embodiments. In the drawings.

DETAILED DESCRIPTION OF THE PREFERRED EMBODIMENTS

Figure 1:
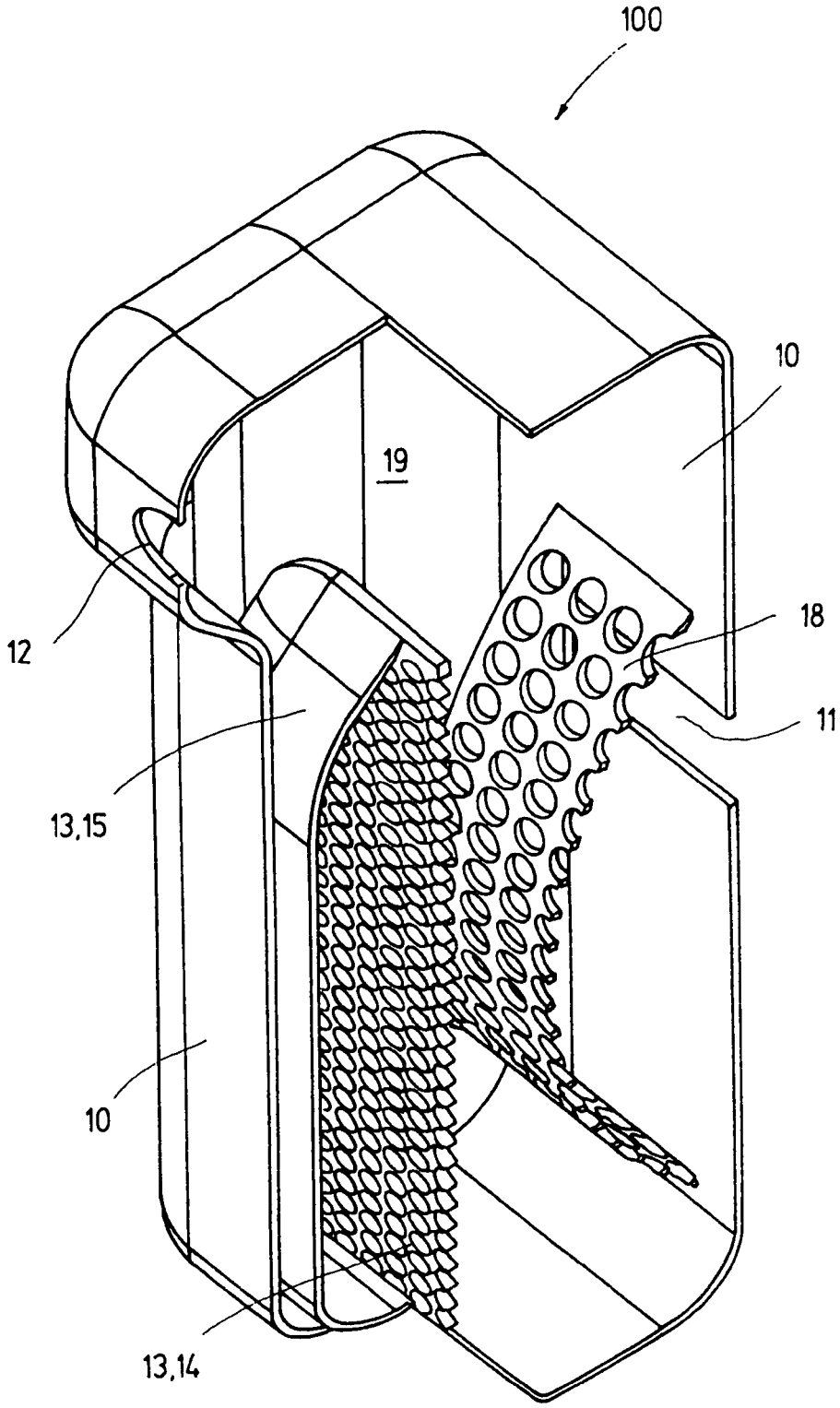
FIG. 1 shows a three-dimensional view of an exhaust system according to the invention, with a cleaning unit and a first, arcuate catalytic element.

FIG. 1 shows a three-dimensional view of a first embodiment of exhaust system 100 according to the invention. A housing 10 of this exhaust system 100 has an essentially cuboid shape. In order to show the internal construction of exhaust system 100 as well, particularly the arrangement of catalytic elements 14, 18 and reflection means 15, exhaust system 100 is shown in partial cutaway. In this particularly advantageous embodiment, a first, arcuate catalytic element 18 is arranged in enclosing or containing manner in front of the aperture for exhaust gas inlet 11. As a result, all inflowing exhaust gases 21 are forced to pass through the first catalytic element before they flow farther into the interior 19 of housing 10. Cleaning unit 13 is positioned directly opposite first catalytic element 18 and inlet aperture 11. This cleaning unit 13 contains a 2-dimensional catalytic element 14 in the form of a perforated panel 14 behind which a bowl-shaped reflection means is arranged. Cleaning unit 13 and catalytic element 18 may be secured in fixed manner inside housing 10 by a welded connection, a clamp, or a positive locking fixture (not shown). In the present case, aperture 16 of reflection means 15 is not partly, but entirely covered by catalytic element 14. To this end, catalytic element 14 may also be affixed to reflection means 15 via a welded connection, a clamp or a positive locking fixture. As was indicated previously, at least a large fraction of the inflowing exhaust gases 21 is directed into cleaning unit 13 via first catalytic element 18. There, the gases then flow through catalytic element 14 in the cleaning unit for the first time. The partially converted exhaust gases are then reflected back to catalytic element 14 by reflection means 15. Consequently, the reflected exhaust gases 22 must pass through catalytic element 14 again to reach cleaning unit 13. Now, a portion of exhaust gases 23 may escape to the outside through the aperture for exhaust gas outlet 12, which is provided in housing 10 in the upper area of exhaust system 100 and opposite inlet aperture 11. The remaining portion of the exhaust gases is mixed with the cool, inflowing exhaust gases 21 and sent through cleaning unit 13 again. This embodiment is particularly suitable for two-stroke engines.

Figure 2:
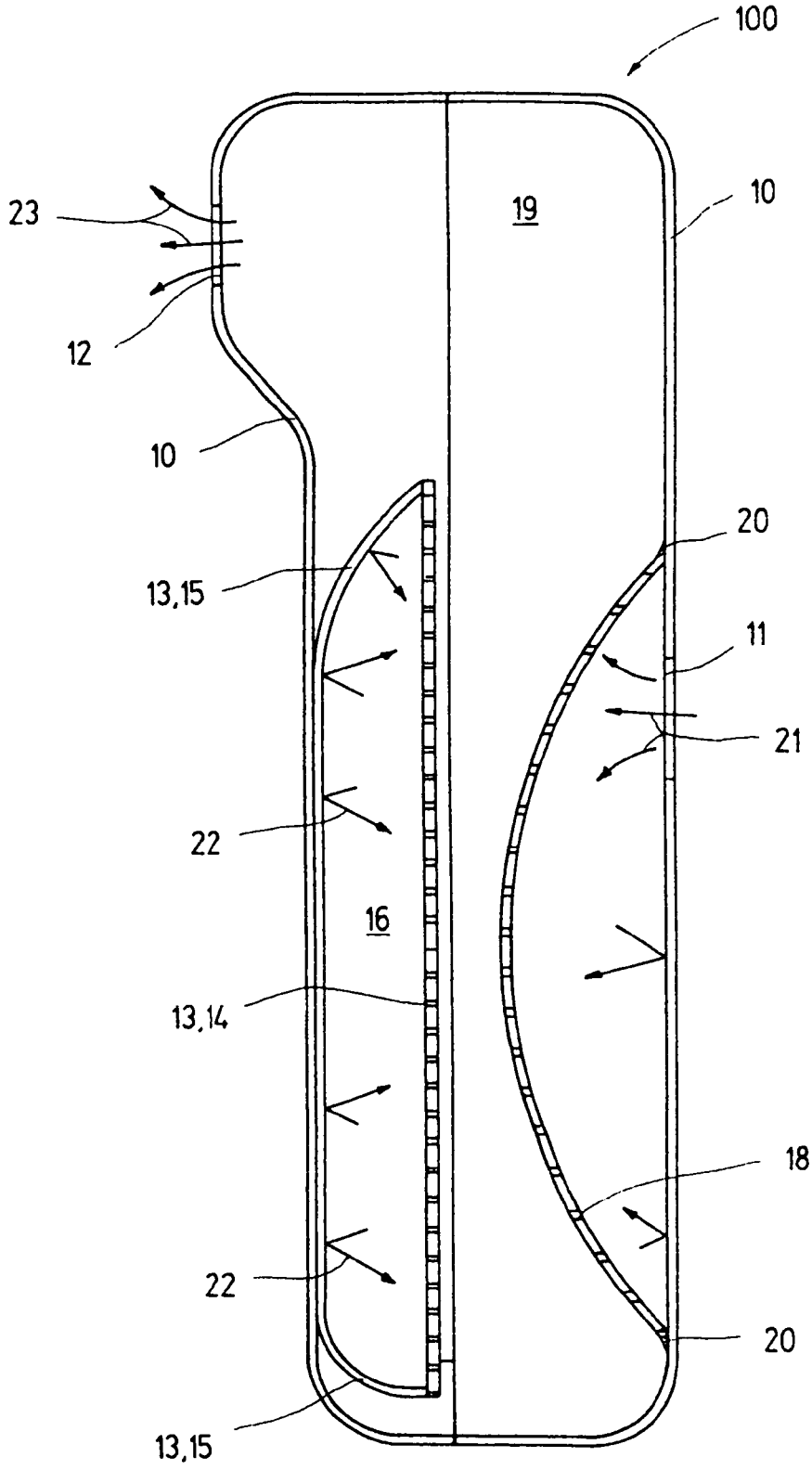
FIG. 2 shows a longitudinal section through the exhaust system according to the invention of FIG. 1.

FIG. 2 provides a clearer illustration of the operating principle of the exhaust system 100 according to the invention, since here the inflowing, reflected and outflowing exhaust gases 21, 22 and 23 are represented as arrows. This figure shows a longitudinal section through exhaust system 100 in the area of inlet and outlet apertures 11, 12 of FIG. 1. As may be clearly seen, inflowing exhaust gases 21 must pass through catalytic element 18 to reach the interior 19 of housing 10. The arcuate design of first catalytic element 18 causes the major portion of the exhaust gases to be directed to the additional catalytic element 14 in cleaning unit 13. Moreover, catalytic element 14 extends above and below arcuate catalytic element. In this way, it may be ensured that most of the inflowing exhaust gases 21 indeed does also pass into cleaning unit 13. In the present case, cleaning unit 13 is not designed as an integral component of housing 10. Therefore, bowl-shaped reflection means 15 has its own floor 17. This is essentially conformed to the shape of housing 10 behind it 10. As a result, it does not have a corrugated or relief shape, because it is flat. The partially converted exhaust gases, which have already passed through catalytic element 14, 18 twice, are directed through catalytic element 14 again, but this time from the inner side. A fraction of these reflected exhaust gases 22 is mixed with fresh, inflowing exhaust gases 21, another part is directed to the outside through the aperture for exhaust gas outlet 12, and a third fraction passes through arcuate first catalytic element 18 again and is then reflected back to cleaning unit 13 by the housing wall. This constant reflection of the exhaust gases in housing 10 also provides good noise damping. If further noise damping is desired, additional reflection or absorption means may be provided in the free, upper area of interior space 19. Since the exhaust gases generally flow through cleaning unit 13 several times before escaping through exhaust system 100. A high conversion rate is achieved even with 2-dimensional catalytic elements 14, 18.

Figure 3:
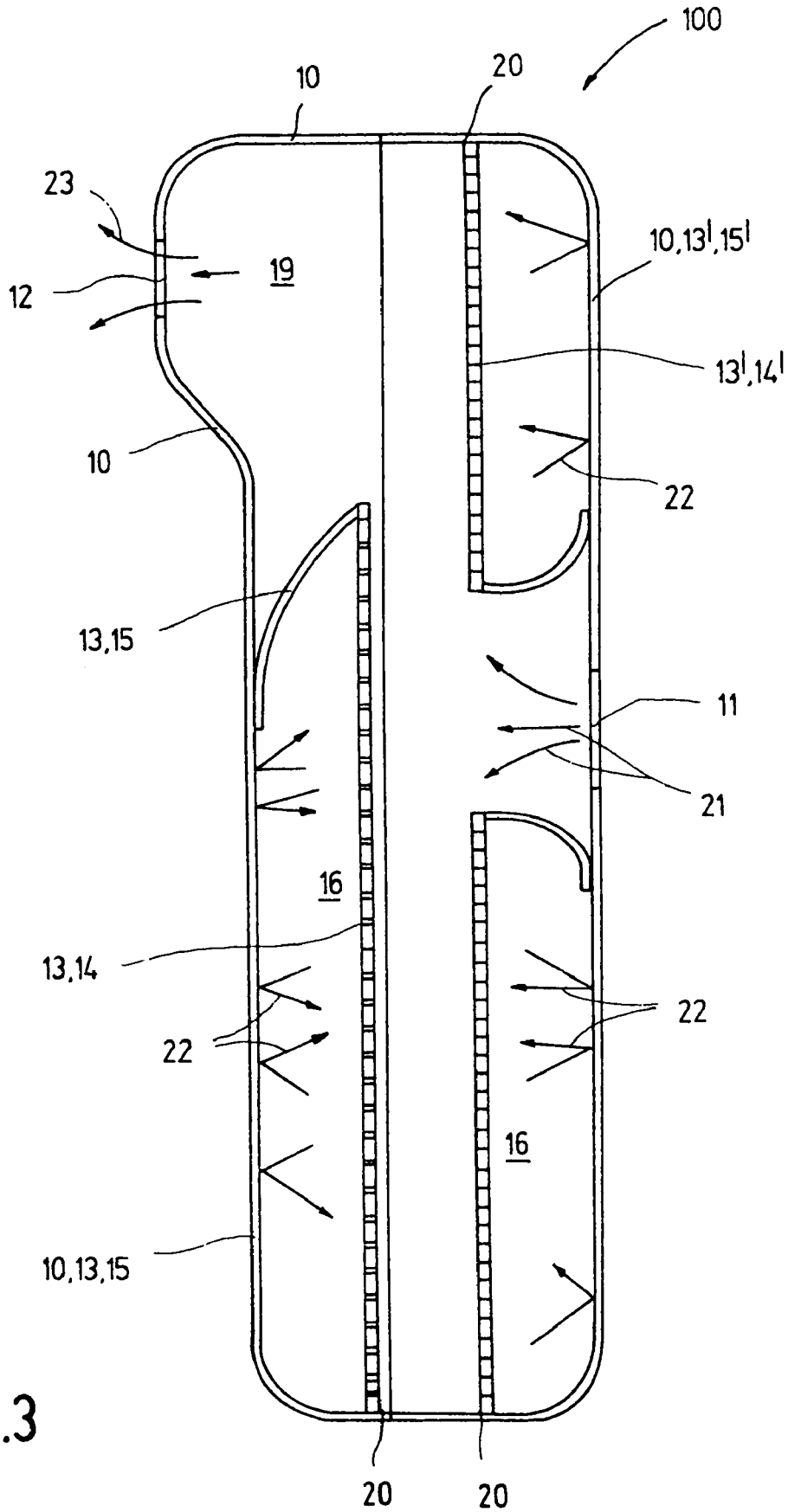
FIG. 3 shows a similar longitudinal section to that of FIG. 2, but through a different embodiment of the exhaust system according to the invention with multiple cleaning units.

The embodiment of FIG. 3 illustrates an exhaust system 100 according to the invention that includes a total of three cleaning units 13, 13'. Of these, as in the configuration of FIGS. 1 and 2 described previously, cleaning unit 13 is arranged opposite the aperture for exhaust gas inlet 11. But cleaning unit 13 is constructed as an integral part of housing 10. In this case, housing 10 serves as floor 17 of reflection means 15. The bottom curvature of bowl-shaped reflection means 15 is also replaced by the existing curvature of the housing (see bottom left corner of housing 10). Only the top curvature of reflection means 14 must be provided as an extra part in housing 10. This extra part may be permanently secured to the housing wall as a curved panel member. This provision not only enables the amount of materials used to be reduced, it also provides a means for improved heat dissipation over the cool surface of the housing. To this end, floor 17 may also be corrugated, so that the surface and therewith the heat dissipation is increased. Additionally, a corrugated or relief-shaped floor 17 prevents reflected exhaust gases 22 from being forced through catalytic element 14 in varying volumes.

In addition, the two further cleaning units 13' are arranged on the housing wall above and below the aperture for exhaust gas inlet 11 (opposite cleaning unit 13). These further cleaning units 13' further increase the number of desirable reflections in housing 10. In this way, the conversion rate may also be improved. The two further cleaning units 13' each include a catalytic element 14' and a reflection means 15'. However, it is also conceivable that the two cleaning units 13' include only one catalytic element 14' that extends fully over both apertures (of reflection means 15'). The advantage of this would be that, exactly in the embodiment of FIGS. 1 and 2, inflowing exhaust gases 21 would be forced to pass through a catalytic element at least once at all events before leaving exhaust system 100 again. The two further cleaning units 13' are each designed as integral components of housing 10.

Also in FIG. 3, a protrusion 20 is shown, via which cleaning units 13, 13' are clamped or hooked inside housing 10. However, these protrusions 20 might also be replaced by a welded seam, via which catalytic elements 14, 14' and/or cleaning units 13, 13' themselves are permanently affixed to the housing.

Figure 4A:
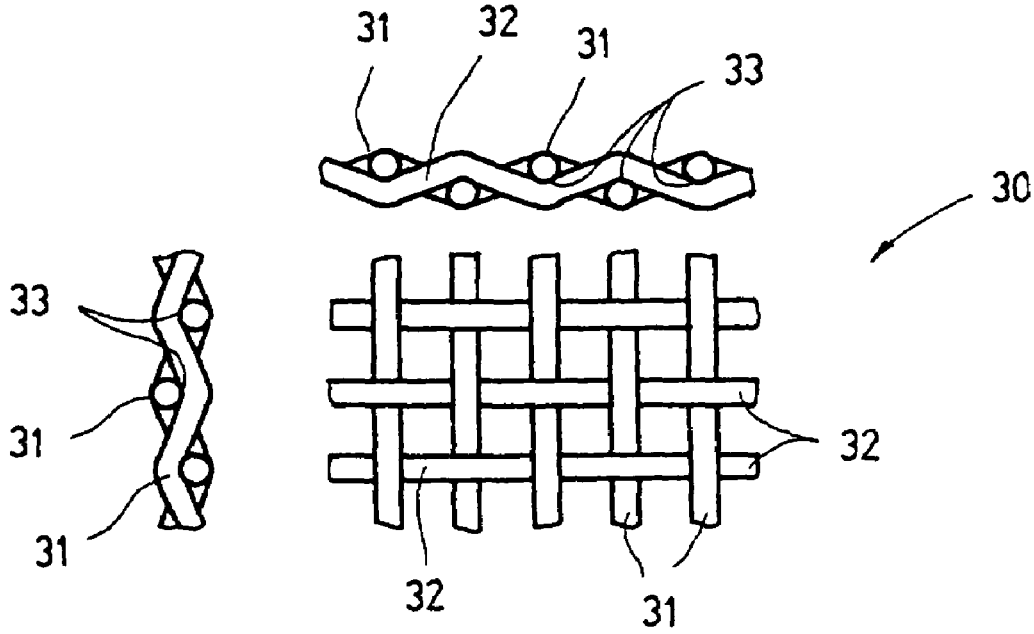
FIG. 4*a* shows a schematic representation of a catalytic mesh for a catalytic element, with simple, alternating weaving of strands.
Figure 4B:
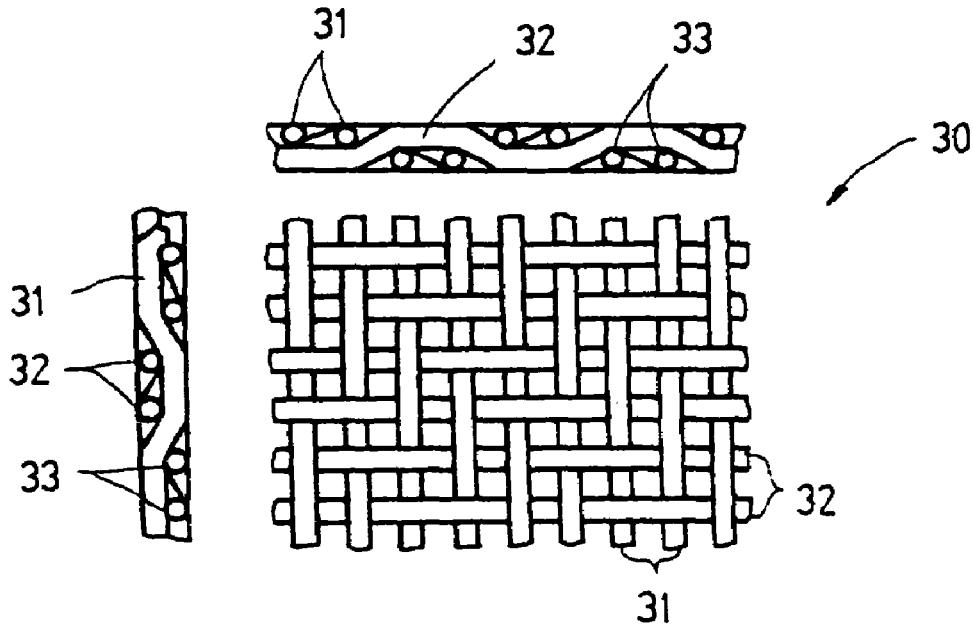
FIG. 4*b* shows a schematic representation of a catalytic mesh for a catalytic element with paired weaving of strands.
Figure 4C:
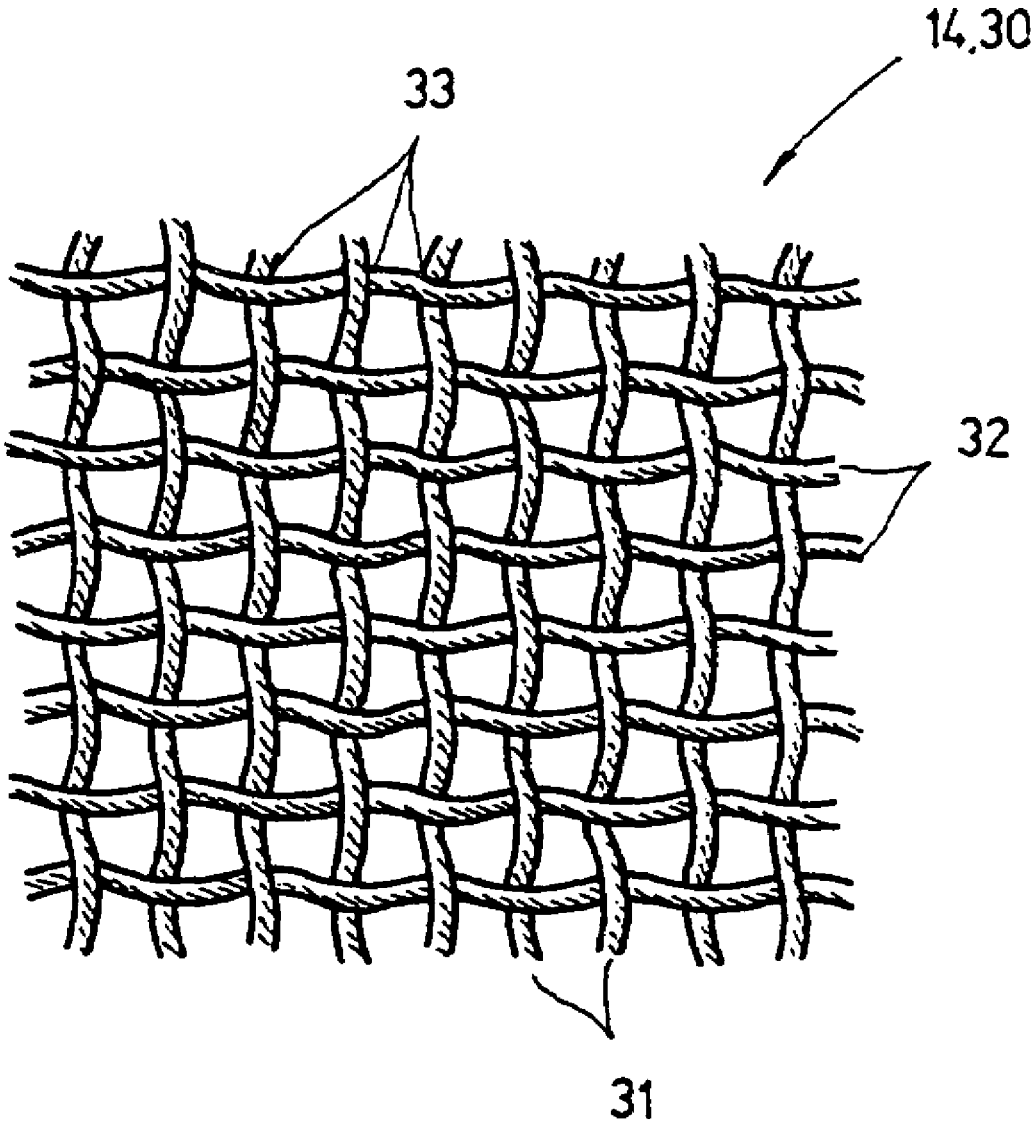
FIG. 4*c* shows a three-dimensional view of the catalytic mesh of FIG. 4*a*, with simple weaving of strands.

Various mesh-like catalytic elements 14, 14', 18 are represented in detail in FIG. 4*a* to *c*. FIGS. 4*a* and 4*b* show cutaway sections of the respective meshes in views from above and from the left. These show respectively a horizontal and a vertical section through the corresponding meshes in FIG. 4*a* and 4*b*. Meshes 30 are themselves made up of horizontal retaining strands 31 and vertical retaining strands 32 that are interlaced or interwoven with each other.

In mesh 30 in the embodiment in FIG. 4*a*, two adjacent, horizontal retaining strands 31 are simply woven together by vertical retaining strands 32 extending transversely thereto. In this example, a horizontal retaining strand 31 passes alternatingly over and under vertical retaining strands 32, which are arranged directly beside each other. The same also applies for vertical retaining strands 32, which pass over and under two adjacent horizontal retaining strands 31. As a result, this mesh 30 has quite normal woven structures, wherein for example horizontal retaining strands 31 resemble a monofilament weft.

To increase the mechanical strength and resilience of mesh-like catalytic element 14, 14', 18, horizontal retaining strands 31 are permanently connection to vertical retaining strands 32 at their common contact points 33. This may be effected for example by welding, soldering or similar. These measures may serve to prevent damaging and noisy resonances in mesh 30.

In FIG. 4*c*, mesh 30 of FIG. 4*a* is shown in three dimensions. In this way, a single representation serves to illustrate clearly the paths of the individual horizontal and vertical retaining strands 31, 32 with respect to each other.

In the variant of mesh 30 shown in FIG. 4*b*, each horizontal retaining strand 31 passes over two adjacent, vertical retaining strands 32 and then passes under the next two adjacent vertical retaining strands 32. Two adjacent horizontal retaining strands 31 pass round opposite sides of one vertical retaining strand 32, thus substantially improving the stability of mesh 30. Even these vertical and horizontal retaining strands 31, 32 may also be attached permanently to each other at their contact points 33. This lends woven structures to mesh 30 also.

Of course, other arrangements for weaving and interlacing the horizontal and vertical retaining strands 31, 32 with each other are conceivable and feasible for creating a mesh 30. A combination of perforated panel and mesh 30 may also be used for catalytic elements 14, 14', 18.

It should also be noted that the exhaust system 100 according to the invention may be used as a complete exhaust system, or also as a starting, middle, or ending installation for an existing partial exhaust system. In the same way, two or more flat or planar catalytic elements 22 may be used at the same time. Many combinations of the various embodiments are possible, unless they are incompatible for technical reasons.

In conclusion, it should be noted that the exhaust gas system 100 according to the invention may also be equipped with technical features other than those described here, which however fulfil the same function.

KEY TO LEGEND

100 Exhaust system
10 Housing
11 Aperture for exhaust gas inlet
12 Aperture for exhaust gas outlet
13 Cleaning unit
13' Additional cleaning unit
14 Catalytic element of 13
14' Catalytic element of 13'
15 Reflection means of 13
15' Reflection means of 13'
16 Aperture of 15
17 Floor of 15
18 Additional catalytic element
19 Interior or interior space of housing 10
20 Protrusion
21 Arrow indicating inflowing exhaust gases
22 Arrow indicating reflected exhaust gases
23 Arrow indicating outflowing exhaust gases
30 Mesh
31 Vertical retaining strand
32 Horizontal retaining strand
33 Contact points of 31 and 32

The invention claimed is:

1. An exhaust system for a combustion engine having a housing in which an aperture is provided for an exhaust gas inlet and a further aperture is provided for an exhaust gas outlet, and having a catalytic element that is arranged in the housing of the exhaust system for cleaning exhaust gases from the combustion engine, characterized in that a cleaning unit is arranged in the housing of the exhaust system and contains at least the catalytic element and reflection means, wherein some or all of the exhaust gases are passed through the catalytic element of the cleaning unit before they reach the reflection means, which passes the exhaust gases through the catalytic element again, this time from another side, and further characterized in that the reflection means is bowl-shaped or parabolic, wherein one aperture of the reflection means is directed towards the catalytic element of the cleaning unit.

2. The exhaust system according to claim 1, characterized in that the exhaust gases flow through the same catalytic element of the cleaning unit multiple times from alternating sides, the reflected exhaust gases being directed from the cleaning unit, though the housing and back to the cleaning unit.

3. The exhaust system according to claim 1, characterized in that the entire aperture of the reflection means is covered by the catalytic element so that all exhaust gases reflected from the cleaning unit flow through the catalytic element.

4. The exhaust system according to claim 1, characterized in that a floor of the reflection means has a corrugated or relief profile, so that accumulation of the reflected exhaust gases is preventable.

5. The exhaust system according to claim 1, characterized in that the reflection means forms a part of the housing.

6. The exhaust system according to claim 1, characterized in that the reflection means comprises stainless steel.

7. The exhaust system according to claim 1, characterized in that the cleaning unit is arranged opposite an aperture for the exhaust gas inlet.

8. The exhaust system according to claim 1, characterized in that the cleaning unit comprises at least one of multiple catalytic elements and multiple reflection means.

9. The exhaust system according to claim 1, characterized in that a second cleaning unit is provided in an interior of the housing.

10. The exhaust system according to claim 9, characterized in that the second cleaning unit is arranged opposite a first cleaning unit, so that the reflected exhaust gases are directed out of the first cleaning unit and into the second cleaning unit.

11. The exhaust system according to claim 1, characterized in that at least one additional first catalytic element is provided in the housing, through which some or all of the entering exhaust gases are directed.

12. The exhaust system according to claim 11, characterized in that an aperture in the exhaust gas inlet is enclosed or contained by the first catalytic element in the interior of the housing.

13. The exhaust system according to claim 12, characterized in that the first catalytic element is arranged in the form of an arc in front of the aperture for exhaust gas inlet.

14. The exhaust system according to claim 13, characterized in that both the one or more additional catalytic elements and the one or more catalytic elements belonging to the cleaning unit are designed as meshes or perforated panels.

15. The exhaust system according to claim 11, characterized in that the catalytic elements are designed as structural supporting members.

16. The exhaust system according to claim 11, characterized in that the catalytic elements are welded or soldered together or permanently connected by some other means at the contact points of the mesh-forming elements.

17. The exhaust system according to claim 11, characterized in that the catalytic elements are partly or entirely coated.

18. An exhaust system for a combustion engine having a housing in which an aperture is provided for an exhaust gas inlet and a further aperture is provided for an exhaust gas outlet, and having a catalytic element that is arranged in the housing of the exhaust system for cleaning exhaust gases from the combustion engine, characterized in that a cleaning unit is arranged in the housing of the exhaust system and contains at least the catalytic element and reflection means, wherein some or all of the exhaust gases are passed through the catalytic element of the cleaning unit before they reach the reflection means, which passes the exhaust gases through the catalytic element again, this time from another side, and further characterized in that a floor of the reflection means has a corrugated or relief profile, so that accumulation of the reflected exhaust gases is preventable.

19. An exhaust system for a combustion engine having a housing in which an aperture is provided for an exhaust gas inlet and a further aperture is provided for an exhaust gas outlet, and having a catalytic element that is arranged in the housing of the exhaust system for cleaning exhaust gases from the combustion engine, characterized in that a cleaning unit is arranged in the housing of the exhaust system and contains at least the catalytic element and reflection means, wherein some or all of the exhaust gases are passed through the catalytic element of the cleaning unit before they reach the reflection means, which passes the exhaust gases through the catalytic element again, this time from another side, and further characterized in that a second cleaning unit is provided in an interior of the housing, wherein the second cleaning unit is arranged opposite a first cleaning unit, so that the reflected exhaust gases are directed out of the first cleaning unit and into the second cleaning unit.

20. An exhaust system for a combustion engine having a housing in which an aperture is provided for an exhaust gas inlet and a further aperture is provided for an exhaust gas outlet, and having a catalytic element that is arranged in the housing of the exhaust system for cleaning exhaust gases from the combustion engine, characterized in that a cleaning unit is arranged in the housing of the exhaust system and contains at least the catalytic element and reflection means, wherein some or all of the exhaust gases are passed through the catalytic element of the cleaning unit before they reach the reflection means, which passes the exhaust gases through the catalytic element again, this time from another side, and characterized in that at least one additional first catalytic element is provided in the housing, through which some or all of the entering exhaust gases are directed, and characterized in that at least one additional first catalytic element is provided in the housing, through which some or all of the entering exhaust gases are directed, and characterized in that an aperture in the exhaust gas inlet is enclosed or contained by the first catalytic element in the interior of the housing, and further characterized in that the first catalytic element is arranged in the form of an arc in front of the aperture for exhaust gas inlet.

21. The exhaust system according to claim 20, characterized in that both the one or more additional catalytic elements and the one or more catalytic elements belonging to the cleaning unit are designed as meshes or perforated panels.

* * * * *